US007247050B1

(12) United States Patent
Minich

(10) Patent No.: US 7,247,050 B1
(45) Date of Patent: Jul. 24, 2007

(54) PRESS-FIT ELECTRICAL CONTACT

(75) Inventor: Steven E. Minich, York, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/586,039

(22) Filed: Oct. 24, 2006

(51) Int. Cl.
*H01R 13/60* (2006.01)

(52) U.S. Cl. ..... 439/567; 439/82

(58) Field of Classification Search ..... 439/567, 439/82, 637, 862
See application file for complete search history.

(56) References Cited

U.S. PATENT DOCUMENTS

| | | | | |
|---|---|---|---|---|
| 3,989,331 A | | 11/1976 | Hanlon | 339/17 |
| 4,575,167 A | | 3/1986 | Minter | 339/17 |
| 4,655,537 A | * | 4/1987 | Andrews, Jr. | 439/751 |
| 4,676,579 A | | 6/1987 | Ting | 439/825 |
| 4,831,728 A | | 5/1989 | Arnhouse | 29/874 |
| 5,073,118 A | * | 12/1991 | Grabbe et al. | 439/71 |
| 5,076,804 A | | 12/1991 | Bertho et al. | 439/567 |
| 5,108,312 A | * | 4/1992 | Sampson | 439/607 |
| 5,409,399 A | | 4/1995 | Geoghegan et al. | 439/567 |
| 6,793,541 B2 | | 9/2004 | Yamaguchi et al. | 439/751 |
| 6,974,337 B2 | * | 12/2005 | Belopolsky et al. | 439/82 |
| 2004/0097141 A1 | | 5/2004 | Belopolsky et al. | 439/857 |

FOREIGN PATENT DOCUMENTS

| | | |
|---|---|---|
| EP | 0 546 673 B1 | 12/1996 |

* cited by examiner

*Primary Examiner*—Michael C. Zarroli
(74) *Attorney, Agent, or Firm*—Woodcock Washburn LLP

(57) ABSTRACT

An electrical contact having a body portion and an curvaceous tail portion extending from the body portion is disclosed. The tail portion may include first and second curved portions defining first and second points of contact, respectively. The first and second points of contact may be offset from one another in a direction of insertion and may be separated by a distance measured perpendicular to the direction of insertion. The distance may be greater than the diameter of a through-hole into which the contact is intended to be inserted. At least a portion of the tail portion may be adapted to rotate upon insertion into the through-hole. The tail portion may exert a force on the sidewalls of the through-hole sufficient to retain the electrical contact in the through-hole. The tail portion may also include a sharp tip that digs into the through-hole plating, thereby impeding movement of the tail portion in a direction opposite to the direction of insertion.

21 Claims, 5 Drawing Sheets

PRESS-FIT ELECTRICAL CONTACT

FIELD OF THE INVENTION

Generally, the invention relates to electrically-conductive contacts for electrical connectors. More particularly, the invention relates to compliant tail configurations for press-fit electrical contacts.

BACKGROUND OF THE INVENTION

Electrical contacts with compliant tail portions are well-known. FIG. 1 depicts a prior-art press-fit electrical contact 100 having body portion 105 and compliant tail portion 110 that extends from body portion 105. The tail portion 110 may include a straight single beam portion 180 that extends from the body portion 105. Each of two curved portions 115, 120 may extend from the beam portion 180. Inner edges 185, 190 of the curved portions 115, 120 may define a slot, or "eye of the needle" 140. The tail portion 110 may define a distal portion 145, which may include a lead-in tip 150.

The curved portions 115, 120 may define opposing contact points 125, 130, respectively. The contact 100 may be inserted into a plated through-hole 132 in a direction of insertion 112. The through-hole 132 may extend through a substrate 122, which may be a printed circuit board (PCB) for example. The contact points 125, 130 may define the maximum width W of the tail portion 110, as measured transverse to the direction of insertion 112. The diameter D of the through-hole 132 may be less than the width W defined between the contact points 125, 130. Consequently, as the tail portion 110 is inserted into the through-hole 132, the sidewalls 133, 134 of the through-hole 132 may exert a compressive force on the tail portion 110 at the contact points 125, 130, thereby compressing the curved portions 115, 120 into the slot 140. The opposing forces at the contact points 125, 130 may define both the insertion force necessary to fully seat the contact in the through-hole, and the retention force necessary to move the contact back out of the through-hole.

With the miniaturization of electronic devices, it is often desirable to reduce the overall size of an electrical connector by reducing the size of its electrical contacts. However, as the contacts become smaller, they may become less physically robust. Thus, the insertion force needed to press fit the electrical contacts into the plated through-holes may be enough to cause the electrical contacts to bend or break.

Also, the slot 140 of the tail portion 110 is typically punched out via die tooling. Given the small size of the tail portion 110 and the slot 104, the die tooling used may need to be small and, consequently, fragile. Such die tooling may be susceptible to damage even after a short period of use. Consequently, the die tooling may need to be repaired or replaced frequently. This may lead to manufacturing delays and/or higher manufacturing costs.

SUMMARY OF THE INVENTION

The invention provides an electrical contact for an electrical connector. Such a contact may have a body portion and a curvaceous tail portion extending from the body portion. The tail portion may define a single beam, having two or more curved portions. Each curved portion may have an outer edge that is adapted to make physical contact with a sidewall of a plated through-hole. The contact points may be offset from one another in a direction along which the contact is intended to be inserted into a through-hole (i.e., the "direction of insertion"). The distance between the contacts points measured perpendicular to the direction of insertion may be greater than the diameter of the through-hole. The curved portions may be adapted to rotate as the contact points make physical contact with the sidewalls of the through-hole. At the contact points, the tail portion may exert a force on the sidewalls of the through-hole that is sufficient to retain the electrical contact in the through-hole. The tail portion may include a sharp tip that digs into the through-hole plating, thereby further securing the contact in the through-hole.

DETAILED DESCRIPTION OF ILLUSTRATIVE EMBODIMENTS

Figure 2A:
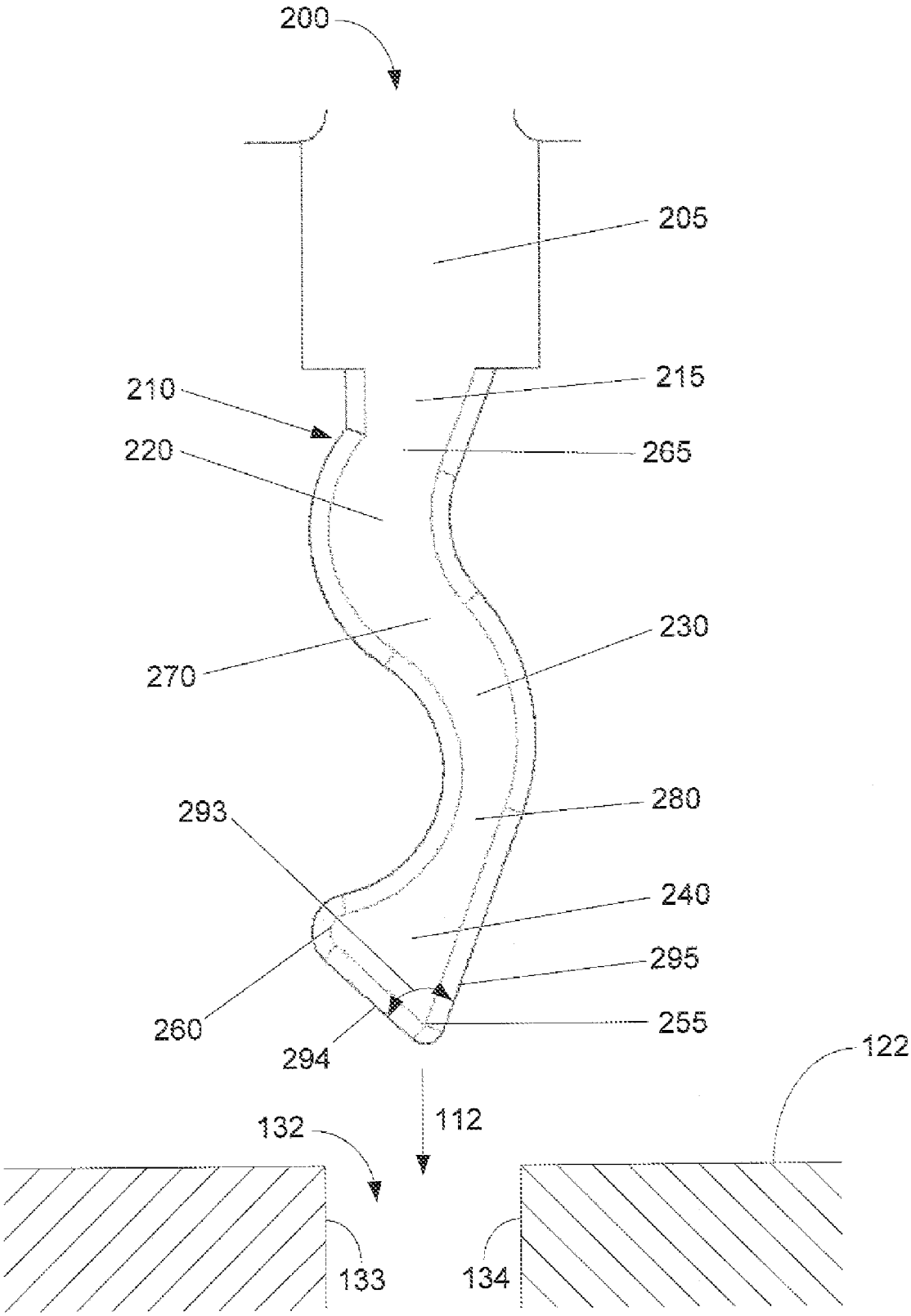
FIGS. 2A and 2B depict a first example embodiment of a compliant tail portion of a press-fit electrical contact according to the invention.
Figure 2B:
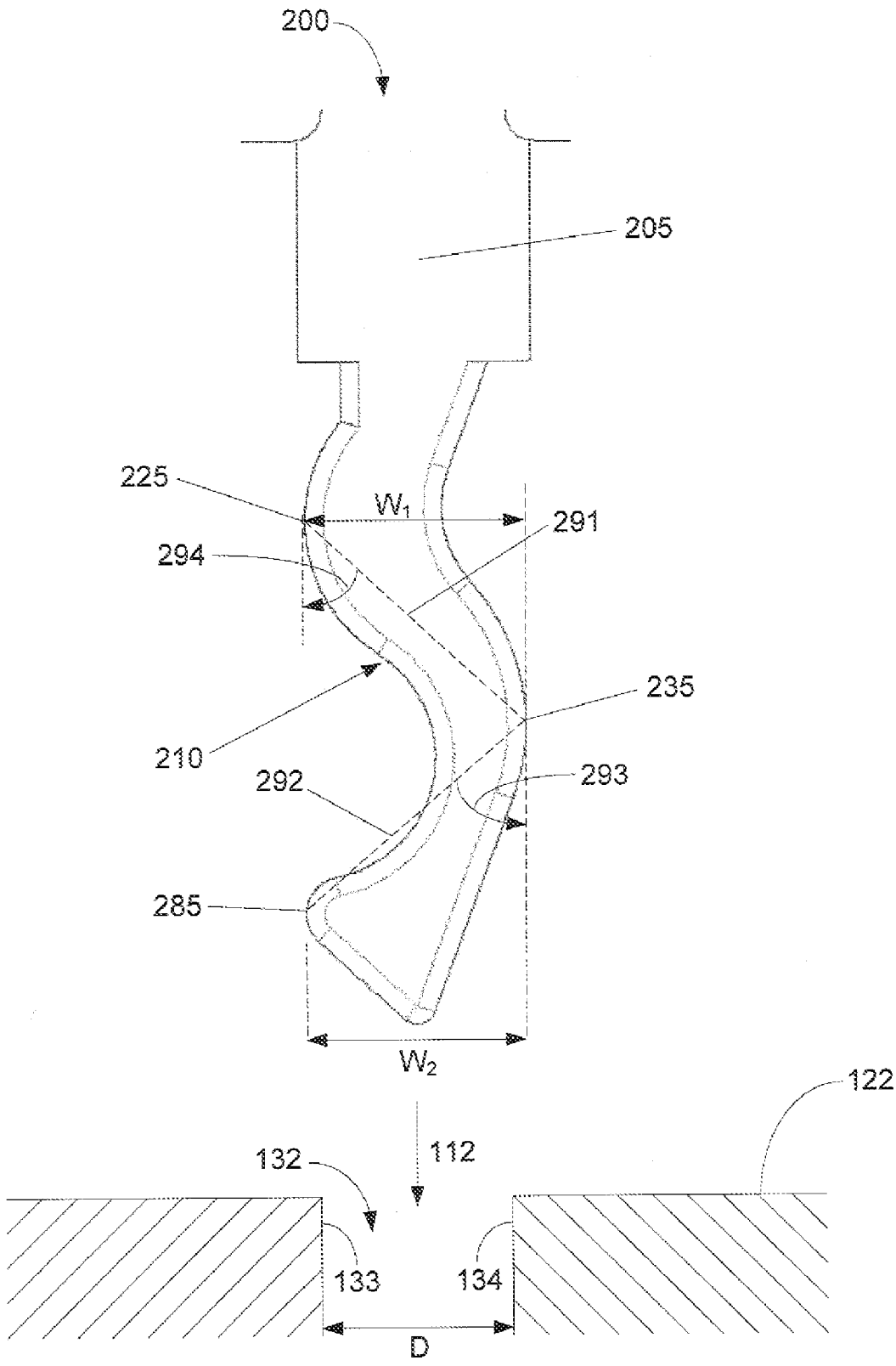

FIGS. 2A and 2B depict an example embodiment of a contact tail portion of a press-fit electrical contact according to the invention. As shown, the contact 200 may have a body portion 205 and a compliant tail portion 210. Such an electrical contact 200 may be stamped from a sheet of conductive material, which may be a copper alloy, or the like.

As shown in FIG. 2A, the tail portion 210 may be devoid of any holes or enclosed slots, thereby eliminating the need for fragile die tooling during the manufacture of electrical contact 200. The tail portion 210 may be a single curvaceous beam that extends from the lower end of the body portion 205. The tail portion 210 may include a stem portion 215, curved portions 220 and 230, and distal end portion 240.

The stem portion 215 may extend from the body portion 205. The lower end 265 of the stem portion 215 may form an angle with the lower end of the body portion 205. The first curved portion 220 may extend from the lower end 265 of the stem portion 215. The second curved portion 230 may extend from the lower end 270 of the first curved portion 220. The distal end portion 240 may extend from the lower end 280 of the second curved portion 230. Thus, the first curved portion may define opposing ends 265, 270. The second curved portion 230 may define opposing ends 270, 280. The lower end 280 of the second curved portion 230 may be farther from the body portion 205 than ends 265 and 270.

The distal end portion 240 may include a rounded lead-in tip 255, lead-in edges 294 and 295, and a curved hook end 260. The lead-in edges 294 and 295 may define a lead-in angle 293, and may facilitate the insertion of the tail portion 210 into a plated through-hole 132 of a substrate 122, which may be a PCB. The tail portion 210 may be inserted into the through-hole 132 in a direction of insertion 112.

As shown in FIG. 2B, the tail portion 210 may define one or more contact points. As shown, the tail portion defines three contacts points: 225, 235, and 285. The contact points 225, 235, 285 are points at which the electrical contact 200 is adapted to make physical contact with the sidewalls 133, 134 of the through-hole 132.

The distances $W_1$ and $W_2$, as measured transverse to the direction of insertion 112 between contact points 225 and 235 and between contact points 235 and 285, respectively, may be greater than the diameter D of the through-hole 132. Consequently, as the tail portion 210 is inserted into the through-hole 132, the sidewalls 133, 134 may exert a force on the contact point 285, then on the contact point 235, and then on the contact point 225, thereby causing the distances $W_1$ and $W_2$ to become smaller. The tail portion 210 may also exert opposite forces on the sidewalls 133, 134 at the contact points 225, 235, and 285. The opposing forces at the contact points 225, 235, 285 may affect both the insertion force required to seat the contact 200 completely into the through-hole 132, and the retention force required to pull the contact 200 back out of the through-hole 132.

The forces acting on the contact points 285 and 235 may cause an axis 292 extending between the contact points 285 and 235 to rotate in a counterclockwise direction 293, as shown in FIG. 2B, about the contact point 235. Similarly, the forces acting on the contact points 235 and 225 may cause an axis 291 extending between the contact points 235 and 225 to rotate in a clockwise direction 294 around the contact point 225. The opposing rotational motions may cause the tail portion 210 to elongate in the direction of insertion 112. The forces acting on the contact points 225, 235, 285 may also cause some compression of the curved portions at the contact points. Thus, the tail portion is adapted to compress both plastically and elastically upon insertion of the tail portion into the through-hole.

Figure 1:
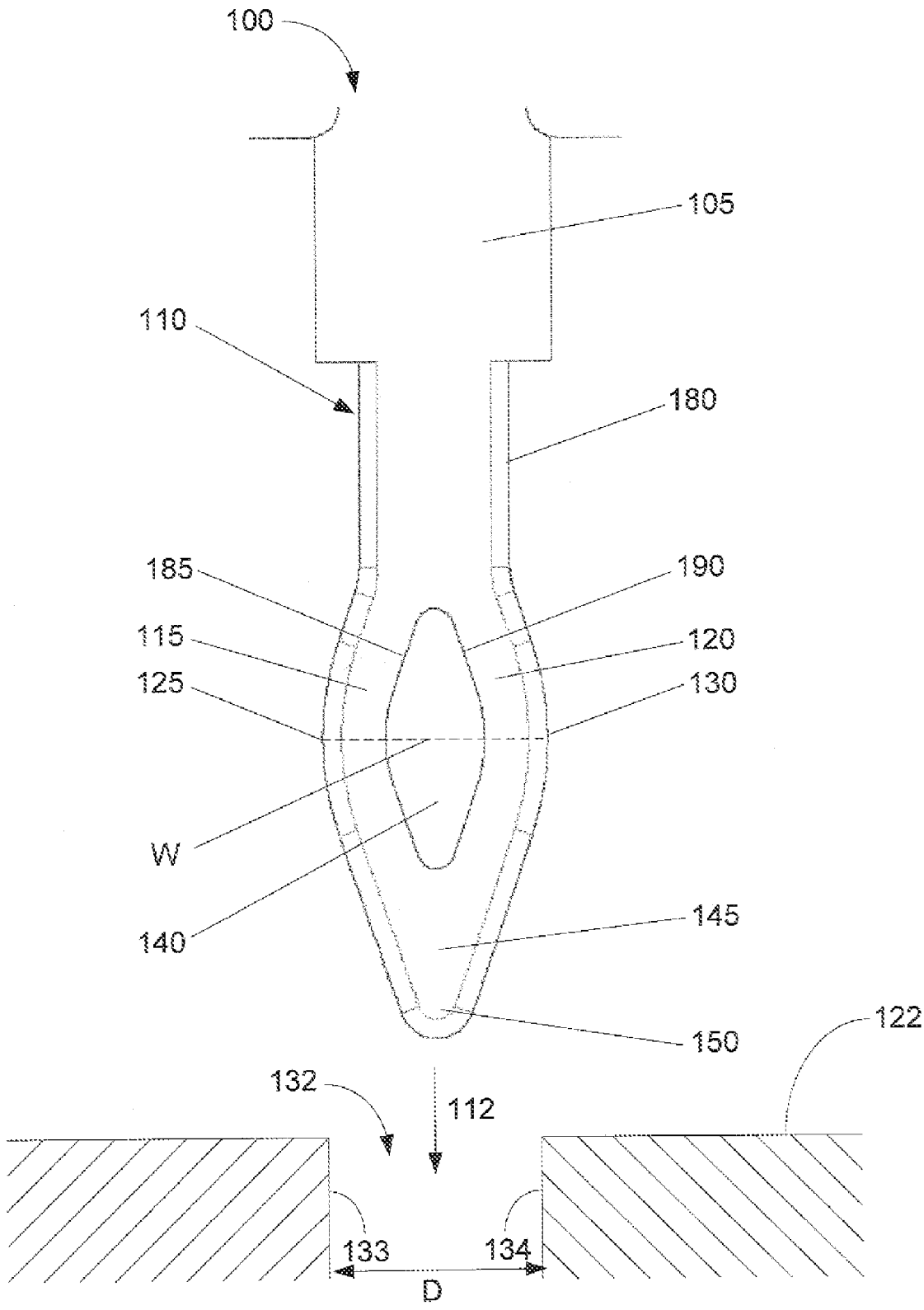
FIG. 1 (Prior Art)
FIG. 1 depicts an example prior-art embodiment of a compliant tail portion of a press-fit electrical contact.

It should be understood that a contact having a single, curvaceous tail portion, as shown in FIGS. 2A and 2B, requires less insertion force that than does a prior art contact having a tail portion as shown in FIG. 1, with two opposing beam portions that need to be compressed into the "eye of the needle" defined between them. It should also be understood that a contact having a tail portion as shown in FIGS. 2A and 2B, with three points of contact, provides more retention force and better electrical conductively with the through-hole plating than does a prior art contact having a tail portion as shown in FIG. 1, with two points of contact.

Figure 3A:
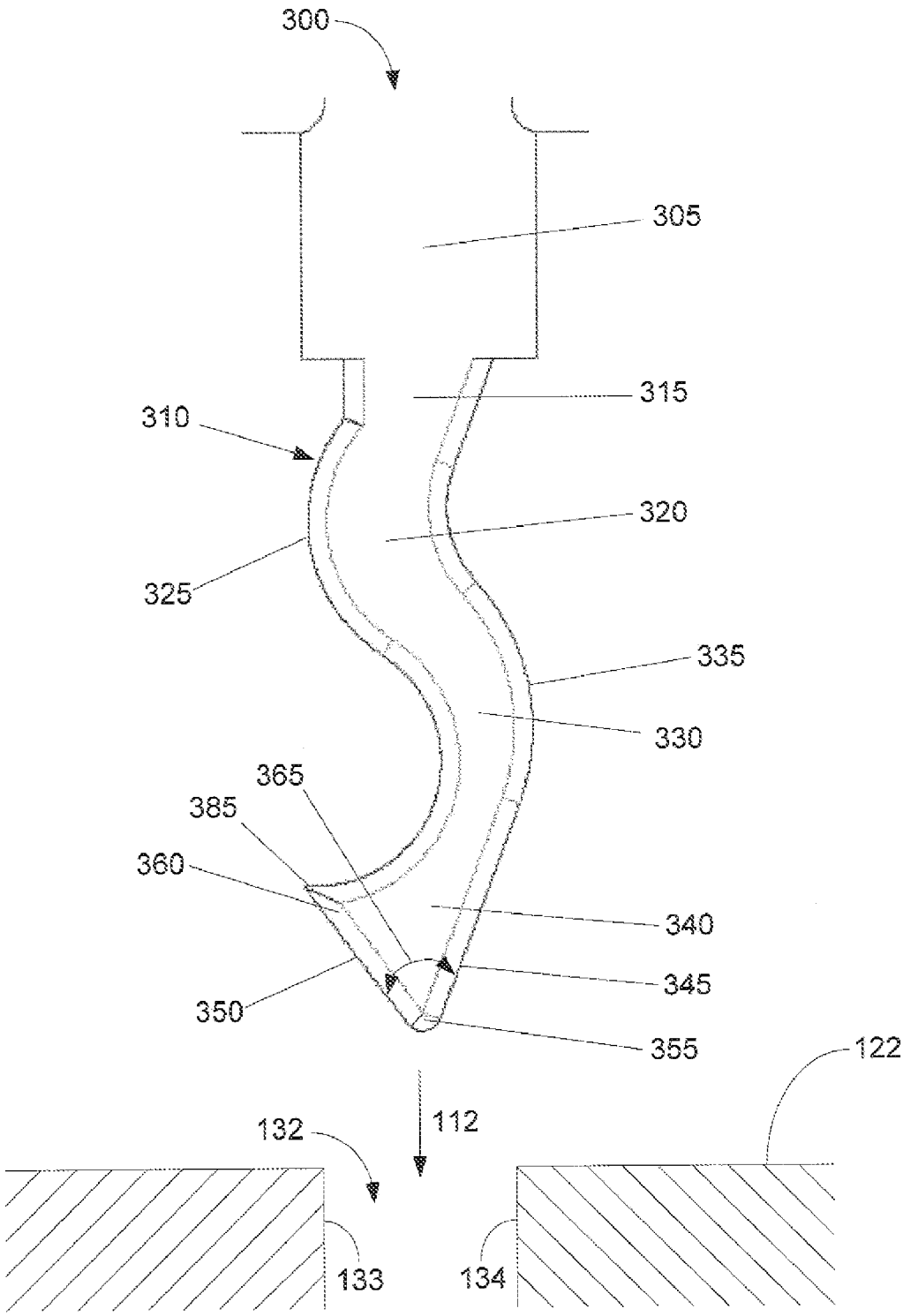
FIGS. 3A and 3B depict a second example embodiment of a compliant tail portion of a press-fit electrical contact according to the invention.
Figure 3B:
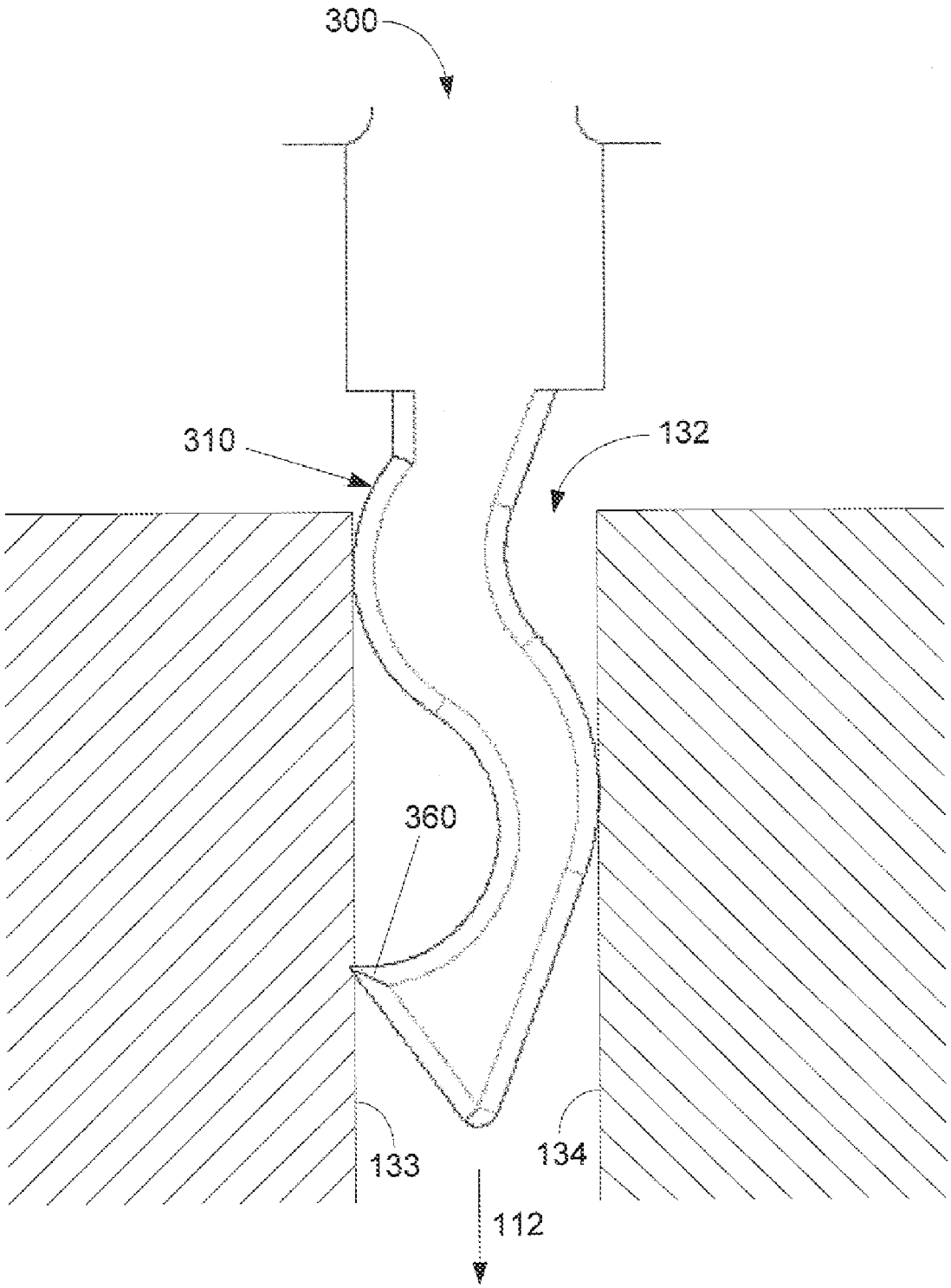

FIGS. 3A & 3B depict a second example embodiment of a contact tail portion of a press-fit electrical contact according to the invention. As shown in FIG. 3A, the contact 300 may have a body portion 305 and a compliant tail portion 310. The tail portion 310 may be a single curvaceous beam that extends from the lower end of the body portion 205. The tail portion 310 may include a stem portion 315, curved portions 320 and 330, and distal end portion 340.

The stem portion 315 may extend from the body portion 305. The lower end of the stem portion 315 may form an angle with the lower end of the body portion 305. The first curved portion 320 may extend from the lower end of the stem portion 315. The second curved portion 330 may extend from the lower end of the first curved portion 320. The distal end portion 340 may extend from the lower end of the second curved portion 330. Thus, each of the curved portions may define respective opposing ends, with the lower end of the second curved portion farthest from the body portion.

The distal end portion 340 may include a rounded lead-in tip 355, lead-in edges 345 and 350, and a sharp hook end 360. The lead-in edges 345 and 350 may define a lead-in angle 365, and may facilitate the insertion of the tail portion 310 into a plated through-hole 132 of a substrate 122, which may be a PCB. The tail portion 310 may be inserted into the through-hole 132 in a direction of insertion 112 and, as shown in FIG. 3A, may define three contact points: 325, 335, and 385. As shown in FIG. 3B, when the contact 300 is pulled in a direction opposite to the direction of insertion 112, the sharp tip of the hook end 360 may dig into the sidewall 133 of the through-hole 132. Thus, the sharp tip of the hook end 360 impedes movement of the tail portion 310 in the direction opposite to the direction of insertion 112 and further increases the retention force of the contact 300.

What is claimed is:

1. A contact for an electrical connector, the contact comprising:

a body portion; and a tail portion extending from the body portion, the tail portion comprising:

a first curved portion having a first end and a second end;

a second curved portion having a third end and a fourth end, wherein (i) the first end of the first curved portion extends from the body portion, (ii) the third end of the second curved portion extends from the second end of the first curved portion, and (iii) the fourth end of the second curved portion is the farther from the body portion than is the third end; and a distal end portion extending from the fourth end of the second curved portion, the distal end portion comprising a lead-in end and a barbed tip.

2. The contact of claim 1, wherein the lead-in end defines a lead-in angle.

3. The contact of claim 1, wherein the tail portion is generally S-shaped.

4. The contact of claim 1, wherein the tail portion is devoid of any holes.

5. A contact for an electrical connector, the contact comprising:

a body portion; and a tail portion extending from the body portion along a direction of insertion, wherein the tail portion defines a single curvaceous beam comprising first, second and third discrete points of contact that are offset from one another in the direction of insertion, wherein, upon insertion of the tail portion into a plated through-hole, the first and third points of contact are adapted to engage a first sidewall of the through-hole and the second point of contact is adapted to engage a second opposing sidewall of the through-hole, and wherein the second point of contact is disposed between the first and third points of contact in the direction of insertion.

6. The contact of claim 5, wherein at least a portion of the tail portion is adapted to rotate upon insertion of the tail portion into the through-hole.

7. The contact of claim 5, wherein the tail portion is adapted to elongate along the direction of insertion upon insertion of the tail portion into the through-hole.

8. The contact of claim 5, wherein the tail portion is adapted to plastically compress upon insertion of the tail portion into the through-hole.

9. The contact of claim 5, wherein the tail portion is adapted to elastically compress upon insertion of the tail portion into the through-hole.

10. The contact of claim 5, wherein at least one of the first, second and third points of contact defines a sharp tip that is adapted to dig into the sidewall upon insertion of the tail portion into the through-hole.

11. A contact for an electrical connector, the contact comprising:

a body portion; and a tail portion extending from the body portion along a direction of insertion, the tail portion being a single, curvaceous beam that defines a first point of contact and a second point of contact, the first and second points of contact being separated by a distance perpendicular to the direction of insertion, wherein at least a portion of the tail portion is adapted to rotate upon insertion of the tail portion into a through-hole having a diameter that is smaller than the distance by which the first and second points of contact are separated.

12. The contact of claim 11, wherein a first curved portion of the tail portion is adapted to rotate in a first direction, and a second curved portion of the tail portion is adapted to rotate in a second direction, upon insertion of the tail portion into the through-hole.

13. The contact of claim 12, wherein the first and second directions are opposite to one another.

14. The contact of claim 11, wherein the tail portion is adapted to elongate upon insertion into the through-hole.

15. The contact of claim 11, wherein at least one of the first and second points of contact defines a sharp tip that is adapted to dig into a plated sidewall of the through-hole and to impede the tail portion from moving in a direction opposite to the direction of insertion.

16. The contact of claim 11, wherein the tail portion is generally S-shaped.

17. A contact for an electrical connector, the contact comprising:

a body portion; and a tail portion defining a single, curvaceous beam that extends from the body portion along a direction of insertion, the tail portion comprising:

a first curved portion extending from the body portion;

a second curved portion extending from the first curved portion; and a distal end portion extending from the second curved portion, wherein the first curved portion and the distal end portion define first and second points of contacts, respectively, along a first edge of the tail portion, wherein the second curved portion defines a third point of contact along a second, opposing edge of the tail portion, and wherein the second point of contact is disposed between the first and third points of contact in the direction of insertion.

18. The contact of claim 17, wherein the first and second curved portions are adapted to rotate in opposing directions upon insertion of the tail portion into a plated through-hole.

19. The contact of claim 17, wherein the distal end portion comprises a barbed tip that defines the second point of contact, and wherein the barbed tip is adapted to dig into a plated sidewall of a through-hole to impede the tail portion from moving in a direction opposite to the direction of insertion.

20. The contact of claim 17, wherein the tail portion is adapted to compress in a first direction at each of the first and second points of contact and to compress in a second, opposing direction at the third point of contact upon insertion of the tail portion into a plated through-hole.

21. The contact of claim 20, wherein the first and second directions are substantially perpendicular to the direction of insertion.

* * * * *